US008851466B2

(12) United States Patent
Kotaka et al.

(10) Patent No.: US 8,851,466 B2
(45) Date of Patent: Oct. 7, 2014

(54) RECORDING APPARATUS

(71) Applicant: Seiko Epson Corporation, Tokyo (JP)

(72) Inventors: Toshikazu Kotaka, Shiojiri (JP); Tetsuya Tamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/777,711

(22) Filed: Feb. 26, 2013

(65) Prior Publication Data

US 2013/0221600 A1 Aug. 29, 2013

(30) Foreign Application Priority Data

Feb. 29, 2012 (JP) ..... 2012-043996

(51) Int. Cl.

| | |
|---|---|
| ***B65H 3/44*** | (2006.01) |
| ***B65H 5/26*** | (2006.01) |
| ***B65H 3/06*** | (2006.01) |
| ***B65H 1/00*** | (2006.01) |
| ***B65H 1/26*** | (2006.01) |

(52) U.S. Cl.

CPC ..... *B65H 1/00* (2013.01); *B65H 2403/42* (2013.01); *B65H 3/44* (2013.01); *B65H 3/0684* (2013.01); *B65H 2404/133* (2013.01); *B65H 3/0669* (2013.01); *B65H 2405/332* (2013.01); *B65H 2405/115* (2013.01); *B65H 2402/32* (2013.01); *B65H 2405/3322* (2013.01); *B65H 1/266* (2013.01)

USPC ..... 271/9.07; 271/9.08; 271/9.11; 271/164; 271/117

(58) Field of Classification Search

USPC ..... 271/145, 162, 164, 117, 118, 9.01, 271/9.07, 9.08, 9.11

See application file for complete search history.

(56) References Cited

U.S. PATENT DOCUMENTS

| | | | | |
|---|---|---|---|---|
| 6,651,974 | B2 * | 11/2003 | Kawarama et al. | 271/121 |
| 7,435,025 | B2 * | 10/2008 | Tanahashi et al. | 400/625 |
| 7,547,011 | B2 * | 6/2009 | Kurata et al. | 271/9.11 |
| 7,628,394 | B2 * | 12/2009 | Kozaki et al. | 271/10.11 |
| 7,828,282 | B2 * | 11/2010 | Zhang | 271/110 |
| 2006/0261535 | A1 | 11/2006 | Shiohara et al. | |
| 2007/0075477 | A1 | 4/2007 | Shiohara | |
| 2009/0001652 | A1 * | 1/2009 | Asada | 271/9.01 |

FOREIGN PATENT DOCUMENTS

| | | |
|---|---|---|
| JP | 11-139598 | 5/1999 |
| JP | 2006-273565 | 10/2006 |
| JP | 2007-091445 | 4/2007 |

* cited by examiner

*Primary Examiner* — Prasad Gokhale
(74) *Attorney, Agent, or Firm* — Workman Nydegger

(57) ABSTRACT

A recording apparatus includes a lower tray which is detachably mounted to an apparatus body, an upper tray provided above the lower tray, which is detachably mounted to the apparatus body, and a feeding roller capable of contacting each of a recording medium stored in the lower tray and the recording medium stored in the upper tray from above. The feeding roller is supported at an intermediate position, which is lower than a position of the feeding roller reached when the feeding roller contacts a bottom surface of the upper tray and higher than a position of the feeding roller reached when the feeding roller contacts a recording medium set as a top sheet in a state in which a maximum number of recording media are stored in the lower tray, in an unmounted state of the upper tray and the lower tray.

7 Claims, 16 Drawing Sheets

RECORDING APPARATUS

BACKGROUND

1. Technical Field

The present invention relates to a recording apparatus including two or more trays which are detachably mounted to an apparatus body and which store a recording medium.

2. Related Art

Paper feed cassettes detachably mounted to an apparatus body have been widely used. In addition, a configuration including two or more paper feed cassettes as upper and lower cassettes and capable of feeding sheets from each paper feed cassette has been widely known. As discussed in JP-A-11-139598, such configurations include a configuration in which a paper feed roller is arranged between upper and lower paper feed cassettes and the paper feed roller is shared by the upper and lower paper feed cassettes, because the size of the apparatus may become large and costs for the apparatus may increase if each of the paper feed cassettes is provided with a paper feed mechanism.

In addition, as discussed in JP-A-2006-273565 and JP-A-2007-91445, there is a configuration including one detachable paper cassette (tray) having a two-layer structure including lower and upper paper storage portions. In this paper cassette, the upper and the lower cassettes are integrally structured and the upper cassette is configured to be pivotable and slidable in relation to the lower cassette. Furthermore, when feeding a sheet from the lower cassette, the upper cassette is allowed to slide so as not to hinder the use of the lower cassette. As a result, the paper feed roller may contact the sheet stored in the lower cassette.

If a configuration is employed in which the feed roller is retracted upward in a state of the upper and lower trays being detached so that the feed roller does not abut onto both the upper and the lower trays, a supporting portion for supporting the feed roller at the retracted position in the state of the upper and lower trays being detached becomes necessary. In this case, it is necessary to provide each of the lower tray and the upper tray with a configuration for releasing the state of supporting the feed roller at the upper position by the supporting portion. Therefore, as a result, the apparatus configuration may become complicated and the costs for the apparatus may increase.

SUMMARY

An advantage of some aspects of the invention is that a recording apparatus including two or more paper storage portions and a supporting portion configured to support a feeding roller at a predetermined position may prevent a complicated apparatus configuration and the increase in the costs. Note that although a paper storage portion for storing sheets included in a recording apparatus is referred to by various terms, such as "cassette", "tray", and the like, the term "tray" is used herein.

According to an aspect of the invention, a recording apparatus includes a recording unit configured to execute recording on a recording medium, a lower tray which is detachably mounted to an apparatus body including the recording unit and which is configured to store a recording medium, an upper tray provided above the lower tray, which is detachably mounted to the apparatus body and which is configured to store a recording medium, and a feeding roller capable of contacting each of the recording medium stored in the lower tray and the recording medium stored in the upper tray from above. The feeding roller is supported at an intermediate position, which is lower than a position of the feeding roller reached when the feeding roller contacts a bottom surface of the upper tray and higher than a position of the feeding roller reached when the feeding roller contacts a recording medium set as a top sheet in a state in which a maximum number of recording media are stored in the lower tray, in a state of the upper tray and the lower tray being detached from the apparatus body.

Suppose that a configuration is employed in which the feeding roller is retracted upward in the state of the upper and lower trays being detached so that the feeding roller does not abut onto both the upper and the lower trays. In this case, as described above, a supporting portion for supporting the feeding roller at the retracted position in the state of the upper and lower trays being detached becomes necessary. Furthermore, in this case, it is necessary to provide each of the lower tray and the upper tray with a configuration for releasing the state of the feeding roller being supported at the upper position by the supporting portion. Therefore, as a result, the apparatus configuration may become complicated and the costs for the apparatus may increase.

However, according to the aspect, the feeding roller is supported at the above-described intermediate position in the state of the upper and lower trays being detached and the feeding roller may be moved from the intermediate position onto the recording medium stored in the upper tray if the recording medium is to be fed from the upper tray and may be moved from the intermediate position onto the recording medium stored in the lower tray if the recording medium is to be fed from the lower tray. Accordingly, the size of the apparatus and the costs for the apparatus may be decreased in the recording apparatus including two or more trays.

It is preferable that, when moving the upper tray to an abutting position in a mounting direction, the feeding roller be displaced upward from the intermediate position when the upper tray is moved, and subsequently the feeding roller be allowed to descend to a position at which the feeding roller contacts the recording medium stored in the upper tray.

In addition, it is further preferable that the recording apparatus further include a rock member provided with the feeding roller, and a pressing member configured to press the rock member in a direction in which an angle formed by a line extending from a position at which the feeding roller and the recording medium contact each other to the center position of a rocking shaft of the rock member and a surface of the recording medium increases, when the angle becomes smaller than a predetermined angle.

With this configuration, if the rock member is configured to displace the feeding roller by rocking around a rocking shaft, an angle formed by the rock member and the recording medium (hereinafter simply referred to as a "wedge angle") becomes smaller in a case where a large number of recording media are stored compared to a case where a small number of recording media are stored. If the wedge angle becomes small, the force of contact between the feeding roller and the recording medium becomes small. As a result, the phenomenon of nonfeed tends to occur. However, according to the aspect, since the recording apparatus includes the pressing member configured to press the rock member toward the recording medium stored in the upper tray if a predetermined number of sheets or more are stored in the upper tray, the phenomenon of nonfeed may be prevented because the force of contact between the feeding roller and the recording medium is compensated for by the pressing member.

In addition, it is further preferable that the upper tray include a stopper portion, which is provided in a leading edge portion thereof in a recording medium feeding direction and capable of contacting a leading edge of the recording medium, and that the stopper portion be configured to push aside the rock member to displace the position of the feeding roller in a course of moving the upper tray to the abutting position in the mounting direction.

With the above-described configuration in which the stopper portion is configured to push aside the rock member in the course of moving the upper tray to the abutting position in the mounting direction, the increase of costs for the apparatus may be prevented because it is not necessary for the upper tray to be provided with a dedicated configuration for engaging the rock member.

Furthermore, it is preferable that, when moving the lower tray to the abutting position in the mounting direction, the lower tray be configured to release the support of the feeding roller at the intermediate position and descend the feeding roller to a position at which the feeding roller contacts the recording medium stored in the lower tray. With this configuration, the configuration for releasing the state of supporting the feeding roller at the above-described intermediate position may be provided only for the lower tray. Accordingly, the size of the apparatus and the costs for the apparatus may be decreased in the recording apparatus including two or more trays.

In addition, it is preferable that the recording apparatus further include a rock member provided with the feeding roller, and a support member configured to support the rock member and support the feeding roller at a position equivalent to the intermediate position and that the support member be configured to engage the lower tray, release the support executed thereby, and release the support of the feeding roller at the intermediate position.

Moreover, it is preferable that the support member include a lever member configured to displace the position of the feeding roller to the intermediate position by contacting the rock member, a pressing member configured to support the position of the feeding roller at the intermediate position by pressing the lever member, and a slider configured to engage the lever member and contact the lower tray in the course of moving the lower tray to the abutting position in the mounting direction, and that the slider be configured to contact the lower tray, slide against a pressing force from the pressing member, and release the support of the feeding roller by the lever member at the intermediate position, in the course of moving the lower tray to the abutting position in the mounting direction.

BRIEF DESCRIPTION OF THE DRAWINGS

The invention will be described, with reference to the accompanying drawings, wherein like numbers reference like elements.

DESCRIPTION OF EXEMPLARY EMBODIMENTS

Hereinbelow, an exemplary embodiment of the present invention will be described with reference to the attached drawings. Note that the invention is not limited to exemplary embodiments of the invention described below. More specifically, the invention may be implemented by various modifications within the scope of the invention as defined in the claims appended hereto. An exemplary embodiment of the invention will be described based on the premise that such modifications are included in the scope of the invention.

Figure 1:
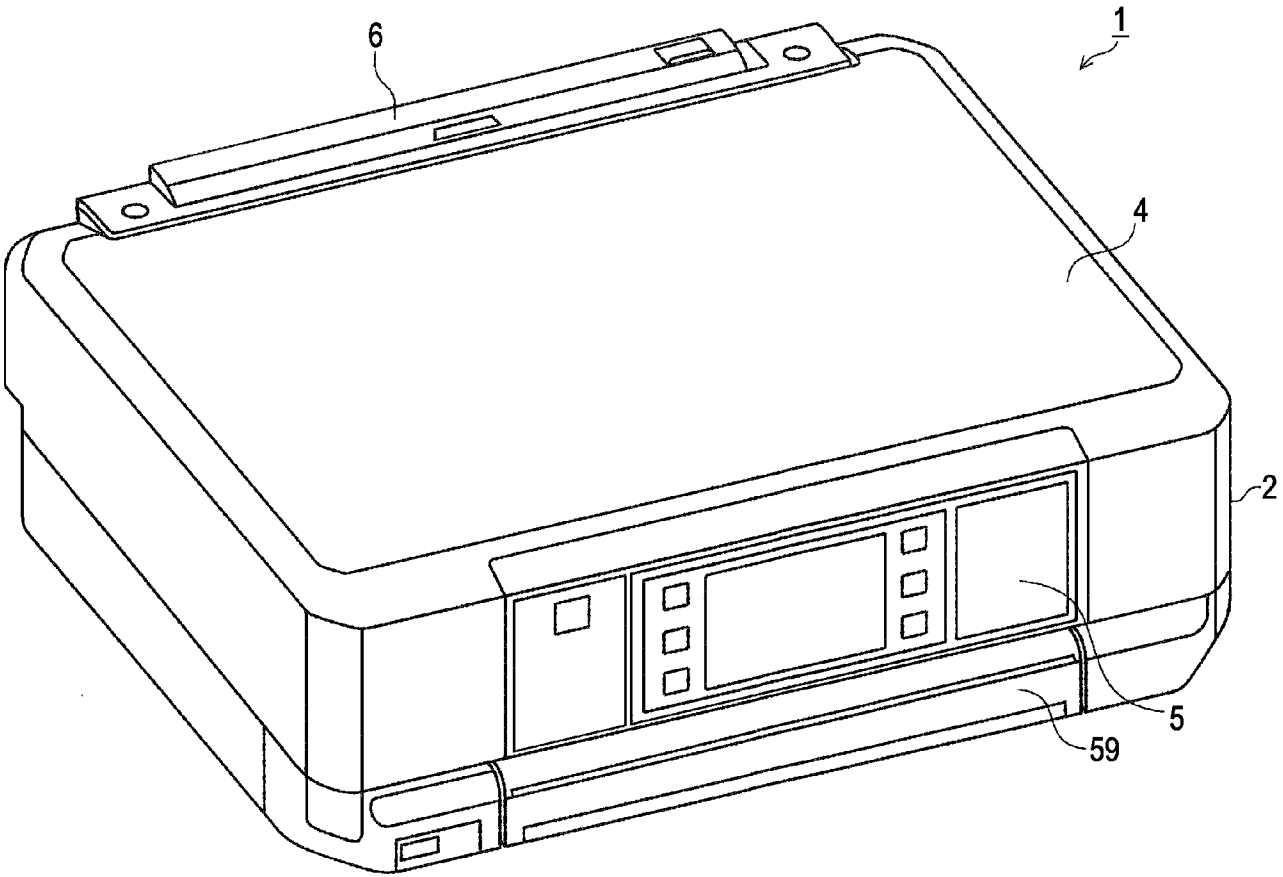
FIG. 1 is an external perspective view illustrating a printer according to the invention.
Figure 2:
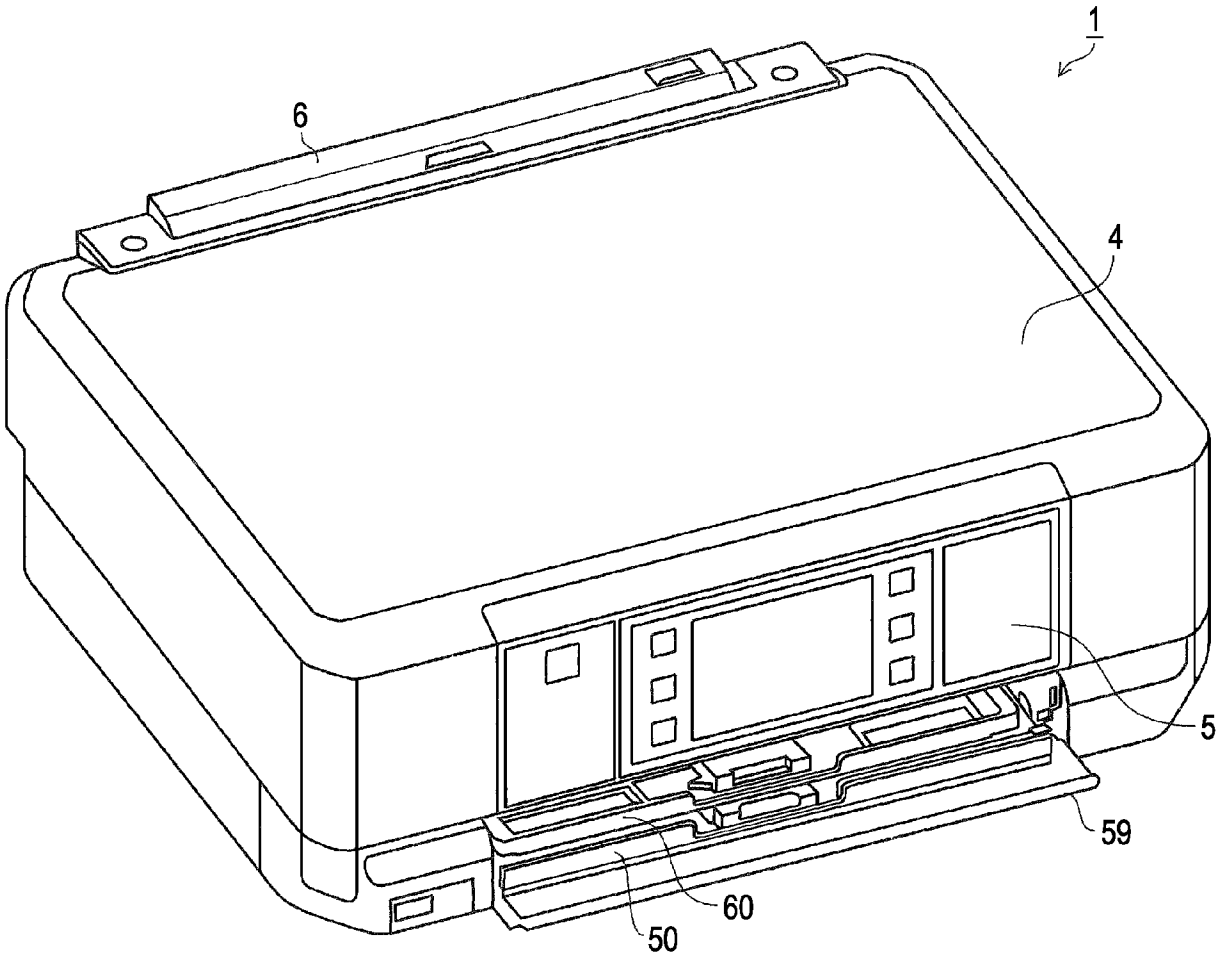
FIG. 2 is an external perspective view illustrating the printer according to the invention.
Figure 3:
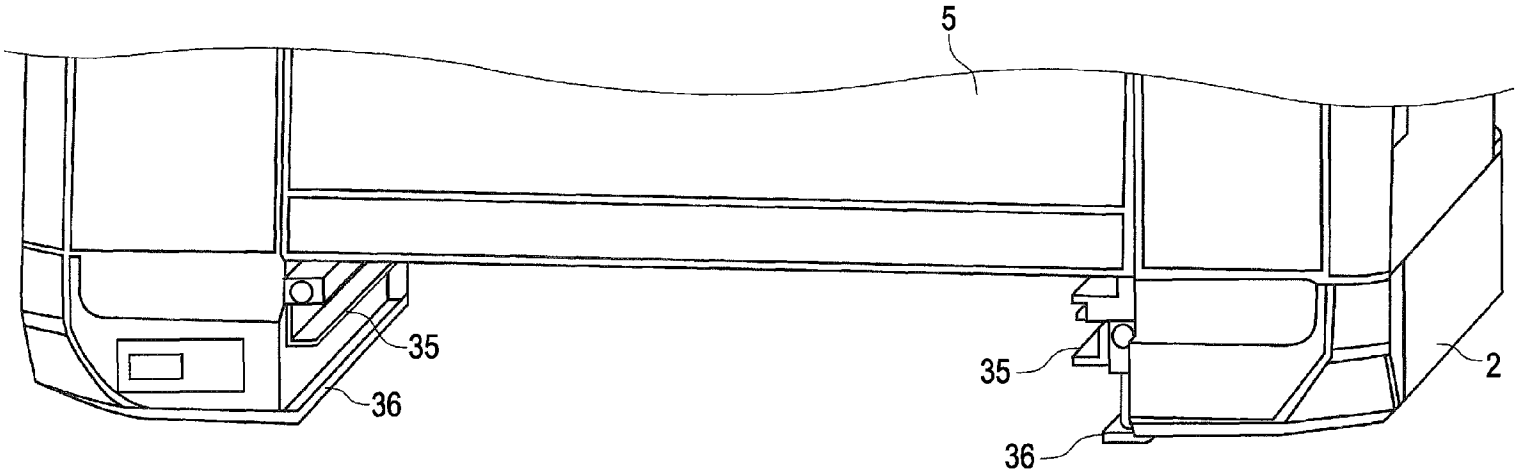
FIG. 3 illustrates elements on larger scale of the apparatus front surface of the printer according to the invention.
Figure 4:
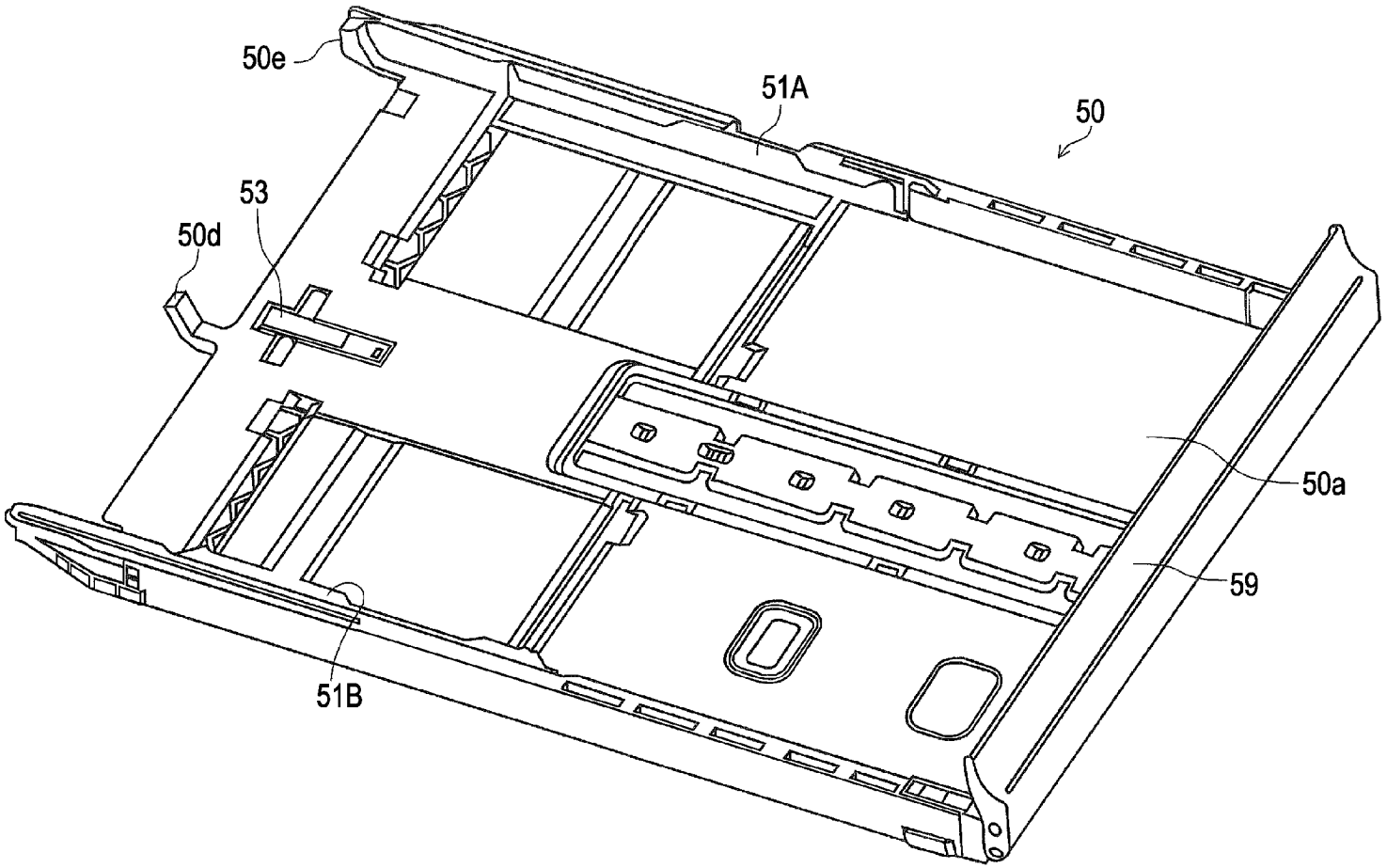
FIG. 4 is a perspective view illustrating a lower tray.
Figure 5:
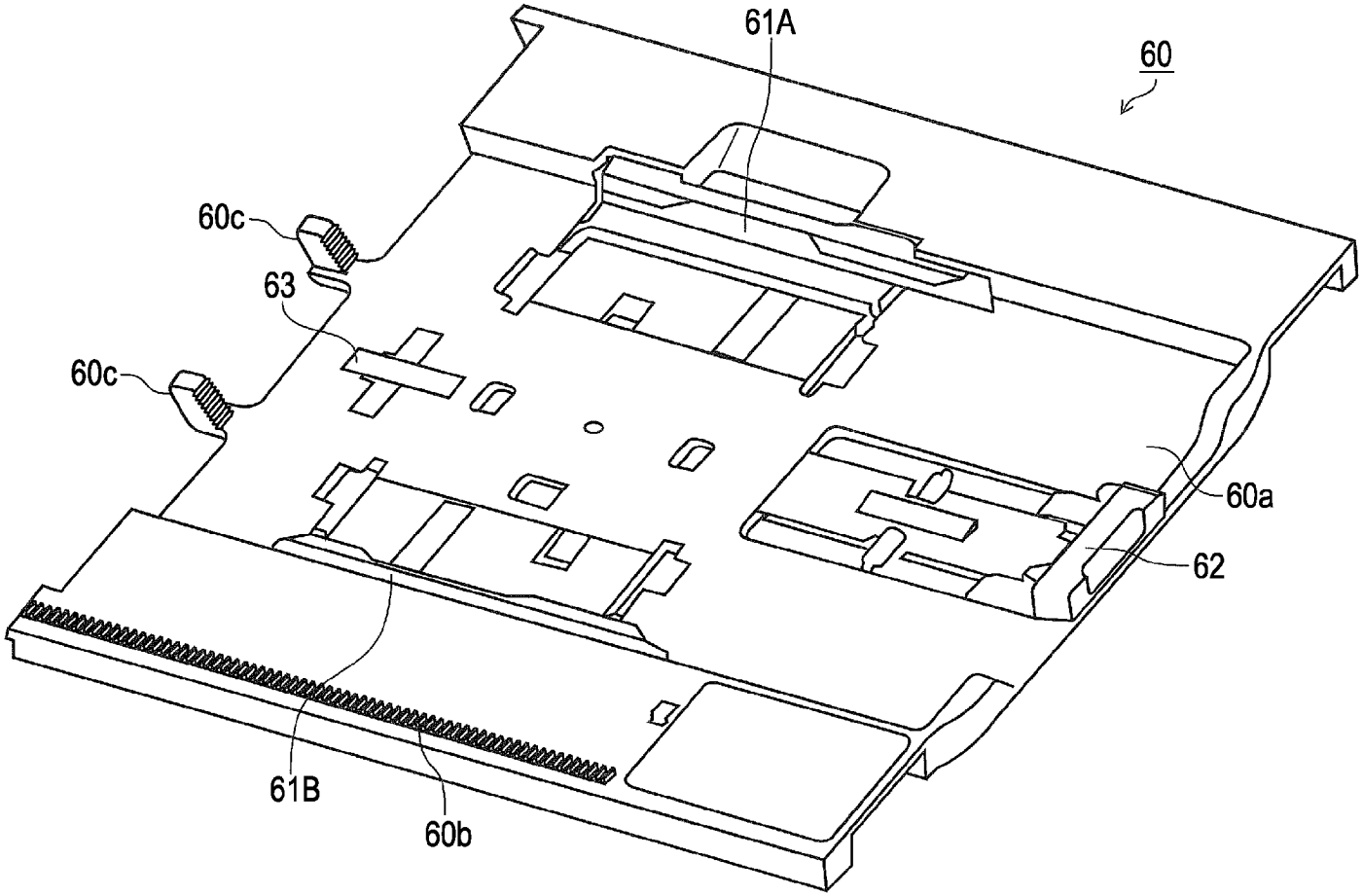
FIG. 5 is a perspective view illustrating an upper tray.

FIGS. 1 and 2 are external perspective views illustrating an ink jet printer (hereinafter simply referred to as a "printer") 1, which is an exemplary embodiment of a "recording apparatus" according to the invention. FIG. 3 illustrates elements on larger scale on the apparatus front surface of the printer 1 in a state in which upper and lower trays are not mounted yet. FIG. 4 is a perspective view illustrating a lower tray 50. FIG. 5 is a perspective view illustrating an upper tray 60.

Figure 6:
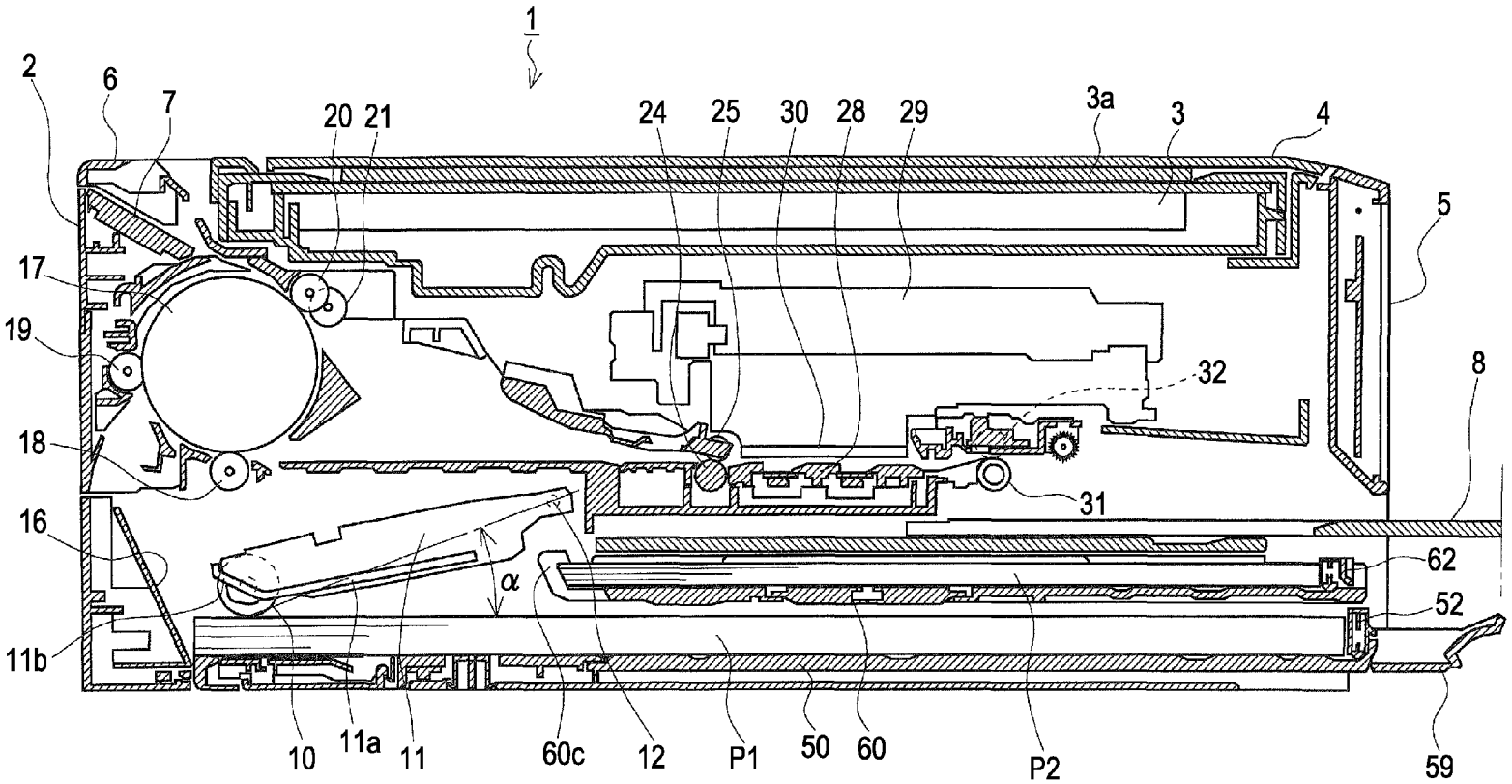
FIG. 6 is a sectional side view illustrating a sheet transport path of the printer according to the invention.
Figure 7:
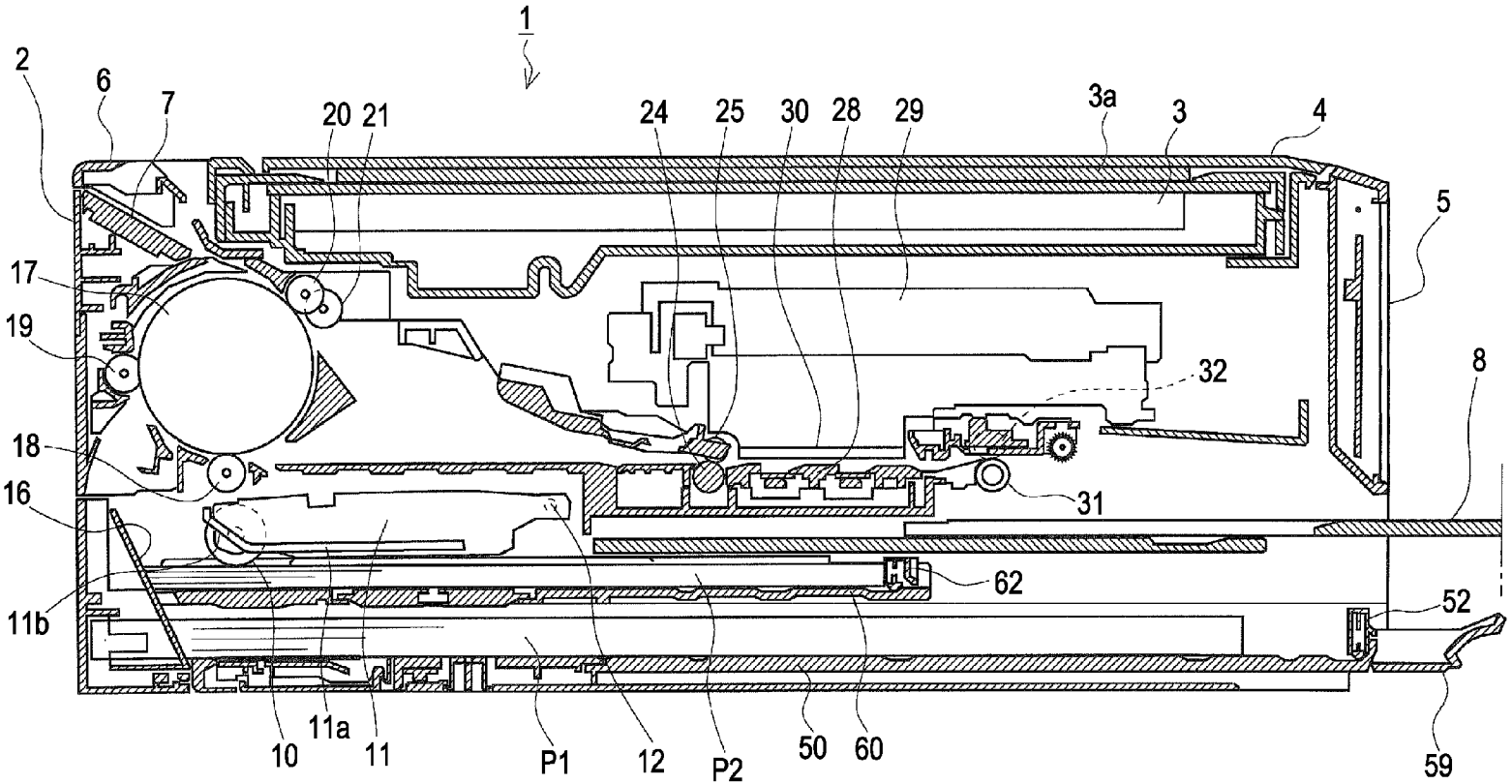
FIG. 7 is a sectional side view illustrating the sheet transport path of the printer according to the invention.
Figure 8:
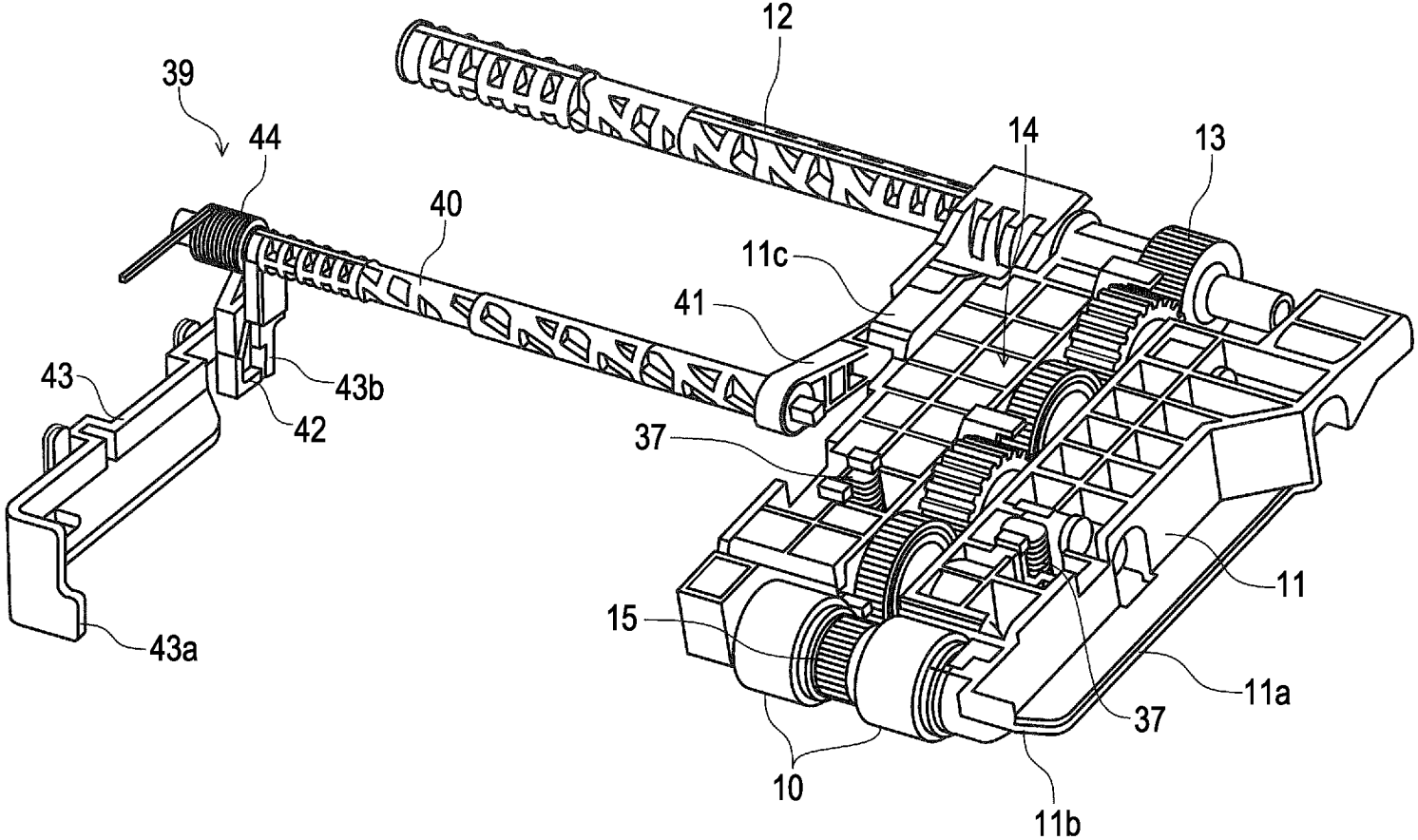
FIG. 8 is a perspective view illustrating a supporting portion for supporting an intermediate position of a feeding roller.
Figure 9:
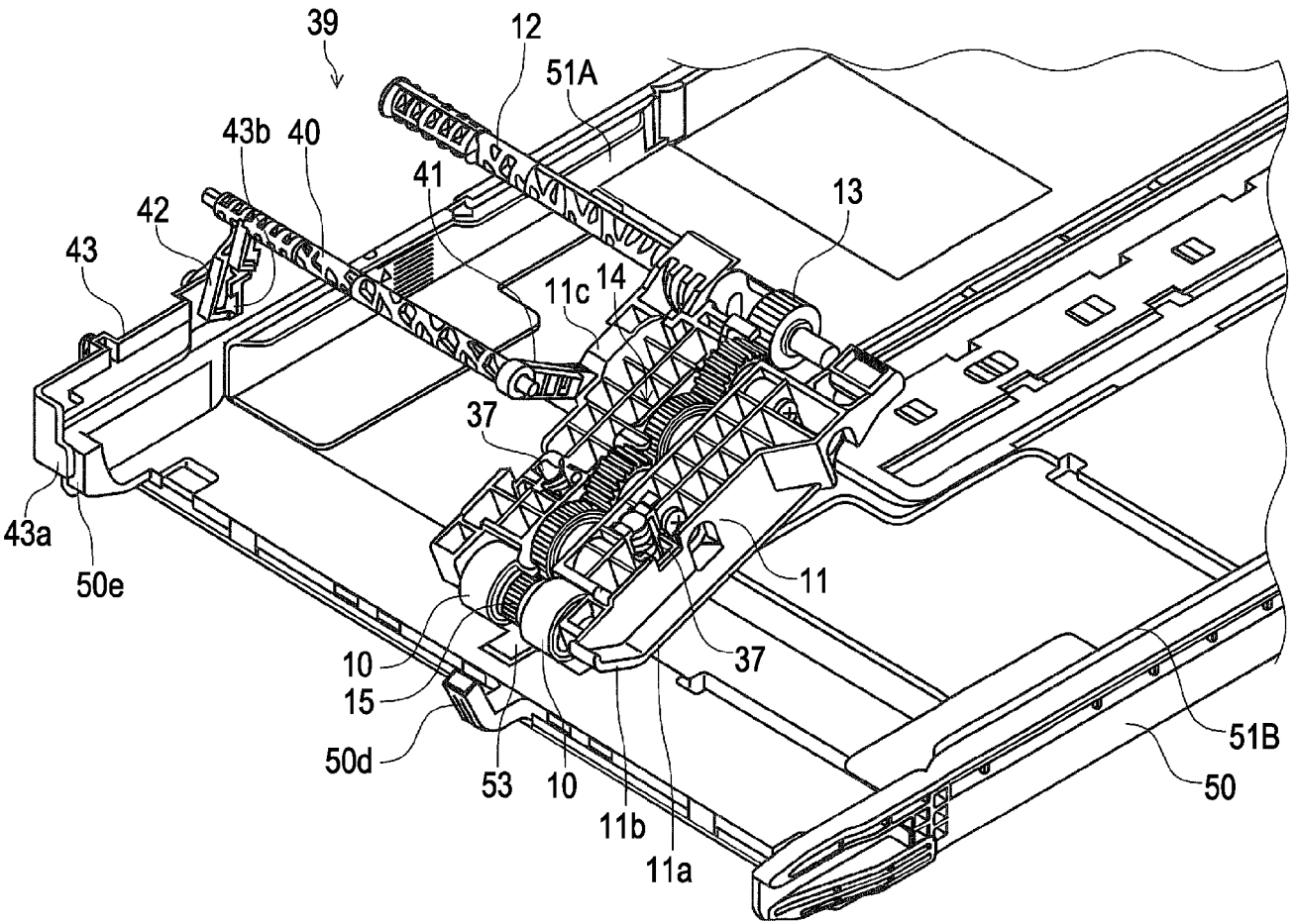
FIG. 9 is a perspective view illustrating the supporting portion for supporting the intermediate position of the feeding roller and the lower tray.
Figure 10:
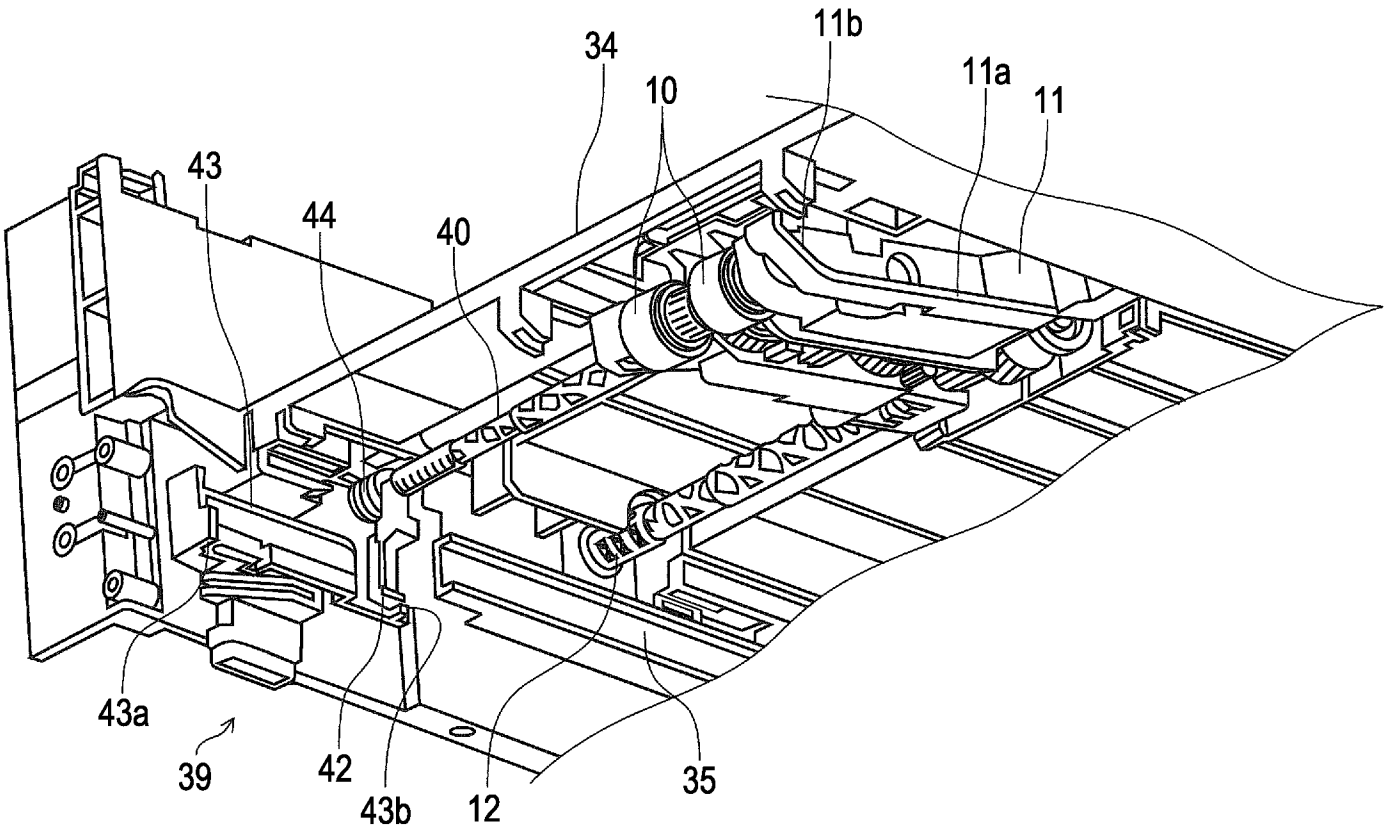
FIG. 10 is an overall perspective view illustrating a state of the supporting portion being mounted for supporting the intermediate position of the feeding roller is mounted.
Figure 11:
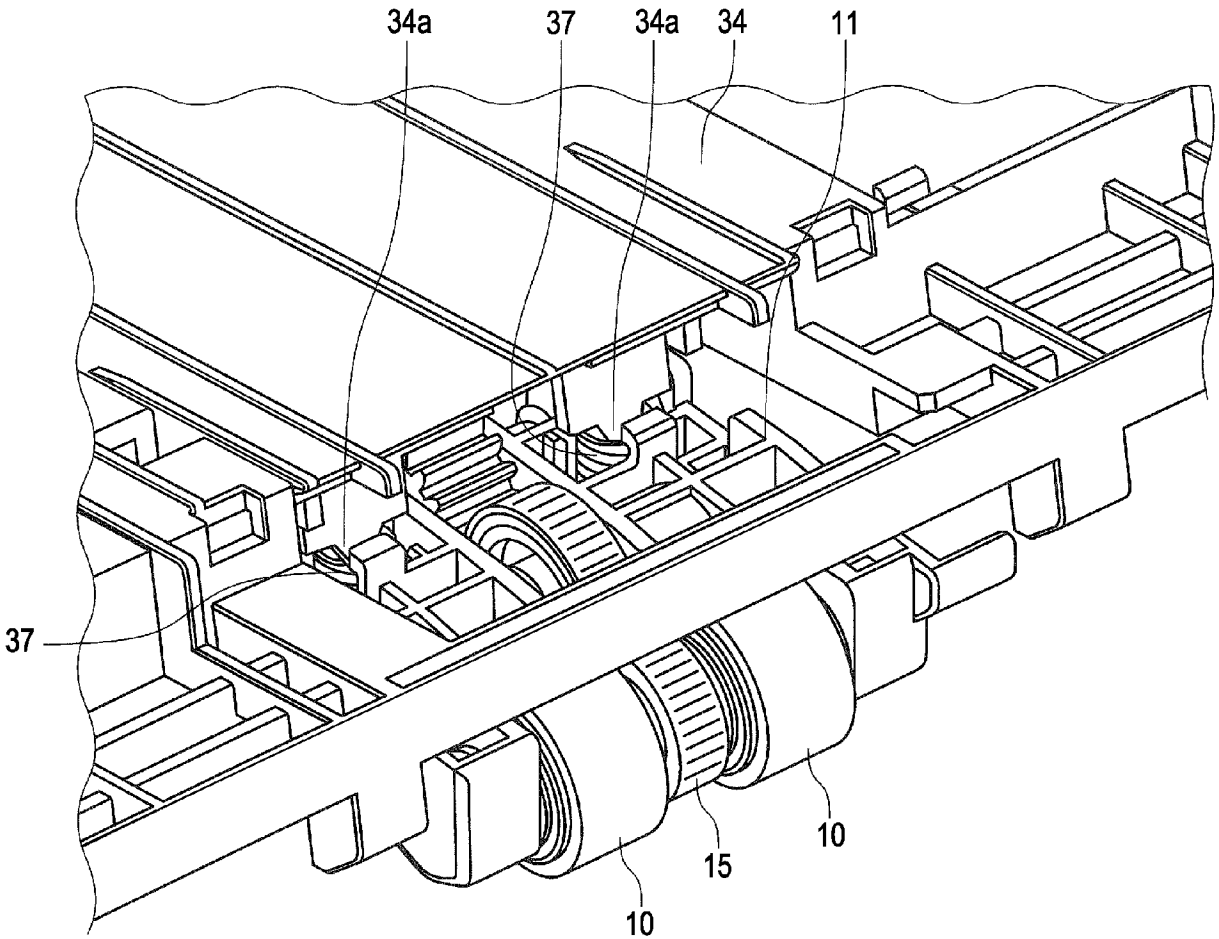
FIG. 11 is a partial magnified perspective view illustrating a state of the supporting portion being mounted for supporting the intermediate position of the feeding roller.
Figure 12:
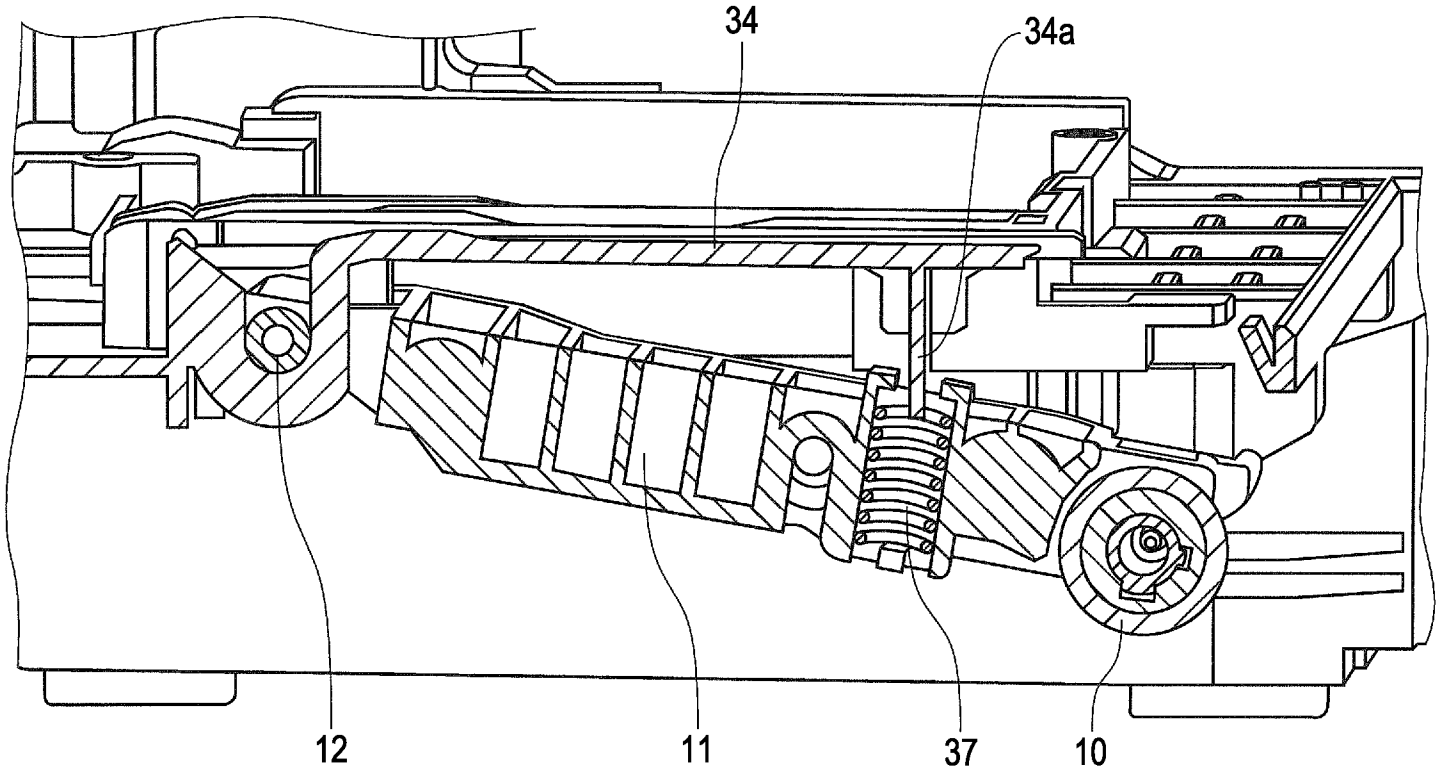
FIG. 12 is a cross section of a rock member and a frame.

In addition, FIGS. 6 and 7 are sectional side views illustrating a sheet transport path of the printer 1. FIG. 8 is a perspective view illustrating a supporting portion 39 configured to support an intermediate position of a feeding roller 10. FIG. 9 is a perspective view illustrating the supporting portion 39 and the lower tray 50. FIG. 10 is an overall perspective view illustrating a state in which the supporting portion 39 is mounted. FIG. 11 is a partial magnified perspective view illustrating a state of the supporting portion 39 being mounted. FIG. 12 is a cross section of a rock member 11, which is a roller supporting member, and the frame 39. Furthermore, FIGS. 13 through 16 are sectional side views illustrating the sheet transport path of the printer 1.

1. Outline Configuration of the Printer

The outline configuration of the printer 1 will be generally described with reference to FIGS. 1 through 7. The printer 1 includes a scanner unit 3, which is provided above an apparatus body (recording unit) 2 configured to execute ink jet recording on a recording sheet that is an example of a recording medium. In other words, the ink jet printer 1 is configured as an MFP having a scanner function in addition to an ink jet recording function.

The scanner unit 3 is provided pivotably in relation to the recording unit 2. The posture of the scanner unit 3 may be shifted between a closed posture (FIG. 1) and an open posture (not illustrated) by pivoting. In the scanner unit 3, an openable/closable cover 4 is provided in an upper portion thereof. By opening the cover 4, a document stand 3*a* (FIGS. 6 and 7) of the scanner unit 3 appears.

On the apparatus front surface, an operation panel 5 is provided, which includes a power switch, operation buttons for executing various print settings and recording, a display unit configured to display content of the print settings and a preview image of an image to be printed, and the like.

In addition, on the front surface of the apparatus, an openable/closable cover 59 is arranged on the lower tray 50. FIG. 1 illustrates a state in which the cover 59 is closed. FIG. 2 illustrates a state in which the cover 59 is opened. The lower tray 50, the upper tray 60, and a discharged sheet-receiving tray 8 appear when the cover 59 is opened.

The discharged sheet-receiving tray 8 is configured to be in a state in which the discharged sheet-receiving tray 8 is stored in the apparatus body 2 (FIGS. 1 and 2) or a state in which the discharged sheet-receiving tray 8 protrudes toward the front of the apparatus body 2 (FIGS. 6 and 7) by a motor (not illustrated). When the discharged sheet-receiving tray 8 is in the state in which the discharged sheet-receiving tray 8 protrudes toward the front of the apparatus body 2, the discharged sheet-receiving tray 8 may receive a recording sheet discharged after recording is executed thereon.

The lower tray 50 and the upper tray 60, which is provided above the lower tray 50, may store a plurality of recording sheets and may be detachably mounted to the apparatus body 2 independently from each other. In addition, as will be described in detail below, even if one of the lower tray 50 and the upper tray 60 is not mounted, the other thereof, which is mounted, may feed a recording sheet. Referring to FIG. 3, lower guide rails 36 guide the lower tray 50 in the attaching/detaching direction and support the lower tray 50. Upper guide rails 35 guide the upper tray 60 in the attaching/detaching direction and support the upper tray 60.

As described above, the lower tray 50 and the upper tray 60 may be attached to and detached from the apparatus body 2 independently from each other. In setting sheets onto one of the trays 50 and 60, it is not necessary to draw out the other thereof. With this configuration, the ease of setting sheets in the recording apparatus having two or more trays may be improved.

Note that as will be described below, the upper tray 60 is configured so as to be slidably displaced between a retracted position (FIG. 6) and an abutting position (FIG. 7) in the state in which the upper tray 60 is mounted to the apparatus body 2. The upper tray 60 is in a "mounted state" regardless of being in the retracted position, abutting position, or a position between the retracted position and the abutting position. Furthermore, if the upper tray 60 is positioned at a position further to the front of the retracted position (further rightward from the position illustrated in FIG. 6), the upper tray 60 is in an incomplete mounting state, i.e., an "unmounted state".

The lower tray 50 is in the "mounted state" when the lower tray 50 is completely pushed to the abutting position (FIGS. 6 and 7). If the lower tray 50 is not in this state, the lower tray 50 is in the "unmounted state". However, hereinbelow, an "upper and lower trays-unmounted state" refers to a state in which both the lower tray 50 and the upper tray 60 are dismounted from the apparatus body 2.

A manual feed cover 6 is provided in the rear upper portion of the apparatus body 2. When the manual feed cover 6 is opened, the recording sheets may be manually fed by utilizing a manual feed tray 7 (FIGS. 6 and 7).

A sheet transport path of the printer 1 will be described with reference to FIGS. 6 and 7. The printer 1 according to the exemplary embodiment is provided with the lower tray 50 and the upper tray 60 in the bottom portion of the apparatus. The recording sheets are fed from the lower tray 50 or the upper tray 60 sheet by sheet.

The upper tray 60 may slide (may be displaced) between a paper feedable position (FIG. 7) and the retracted position (FIG. 6). The upper tray 60 is configured to be displaced between the paper feedable position (FIG. 7) and the retracted position (FIG. 6) by the power of a motor (not illustrated).

Note that in FIGS. 6 and 7, a sheet P1 is stored in the lower tray 50 and a sheet P2 is stored in the upper tray 60. Hereinbelow, the sheets P1 and P2 are collectively referred to as a "sheet P" or "sheets P" unless it is necessary to distinguish between them.

The rock member 11, which rocks around a pivot shaft 12, is provided with a feeding roller (pickup roller) 10 that is rotationally driven by a motor (not illustrated). When the upper tray 60 is in a state of being slid most toward the apparatus front (i.e., rightward in FIGS. 6 and 7 (to the side of drawing out the upper tray 60)), in other words, when the upper tray 60 is in the retracted position (the state illustrated in FIG. 6), the feeding roller 10 contacts a top sheet of the sheets P1 stored in the lower tray 50 and rotates in this state to feed the top sheet P1 from the lower tray 50.

In addition, when the upper tray 60 is positioned at the abutting position at which the upper tray 60 has slid most toward the rear side of the apparatus (i.e., leftward in FIGS. 6 and 7 (in the direction of mounting the upper tray 60 and in the sheet feed direction)), in other words, when the upper tray 60 is positioned at the paper feedable position (the state illustrated in FIG. 7), the feeding roller 10 contacts a top sheet of the sheets P2 stored in the upper tray 60 and rotates in this state to feed the top sheet P2 from the upper tray 60. Note that even if one of the lower tray 50 and the upper tray 60 is not mounted, sheets may be fed from the other thereof that is mounted. With this configuration, the sheet may be flexibly fed and thereby the apparatus may be more easily handled.

Note that in the exemplary embodiment, as illustrated in FIG. 8, the pivot shaft 12 constitutes a rocking shaft of the rock member 11. In addition, the pivot shaft 12 turns by the power of the motor (not illustrated) to transmit the power from a transmission gear 13, which is provided in the pivot shaft 12, to a transmission receiving gear 15, which is provided integrally with the feeding roller 10, via a gear train 14. Note that in the exemplary embodiment, the feeding rollers 10 are provided at both sides of the transmission receiving gear 15.

Returning to FIGS. 6 and 7, the apparatus body 2 is provided with a separation slope 16, which is provided at a position opposing leading edges of the lower tray 50 and the upper tray 60. In a state in which the lower tray 50 has been mounted, a stopper 50*d* (FIG. 4), which is provided at the leading edge of the lower tray 50, enters the back of the separation slope 16 (leftward in FIG. 6). In this state, the leading edge of the sheet stored in the lower tray 50 may contact the separation slope 16.

In addition, in the upper tray 60, in a state in which the upper tray 60 is positioned at the paper feedable position (the abutting position illustrated in FIG. 7), a stopper 60*c*, which is provided at the leading edge of the upper tray 60, enters the back of the separation slope 16. In this state, the leading edge of the sheet stored in the upper tray 60 may contact the separation slope 16.

The sheet P, which is fed from the lower tray 50 or the upper tray 60 and which is transported toward the downstream side while the leading edge thereof keeps contacting the separation slope 16. The top sheet P to be fed is thus separated from the other sheets P stored below the top sheet.

On the downstream side of the separation slope 16, an intermediate roller 17, which is rotationally driven by a motor (not illustrated), is provided. The sheet P is bent and reversed by the intermediate roller 17 to be transported toward the apparatus front. Note that driven rollers 19 through 21 may be driven to be rotated. The sheet P is nipped at least by the driven roller 19 and the intermediate roller 17 and is then nipped by the driven roller 20 and the intermediate roller 17 to be transported toward the downstream side.

On the downstream side of the intermediate roller 17, a transport drive roller 24, which is rotationally driven by a motor (not illustrated), and a transport driven roller 25, which contacts the transport drive roller 24 to be rotationally driven, are provided. The sheet P is transported by the rollers 24 and 25 to a position below a recording head 30.

The recording head 30 configured to eject an ink is provided at a bottom of a carriage 29. The carriage 29 is driven by a motor (not illustrated) so as to reciprocate in the main scanning direction (in a direction perpendicular to the surface of the sheet in FIGS. 6 and 7).

A support member 28 is provided at a position opposing the recording head 30. The support member 28 regulates the clearance between the sheet P and the recording head 30. On the downstream side of the support member 28, a discharge drive roller 31, which is rotationally driven by a motor (not illustrated), and a discharge driven roller 32, which contacts the discharge drive roller 31 to be rotationally driven, are provided. After recording by the recording head 30 is carried out on the sheet P, the sheet P is discharged by the rollers 31 and 32 toward the above-described discharged sheet-receiving tray 8.

2. Details of the Paper Feed Mechanism

The outline configuration of the printer 1 is described above. Hereinbelow, the paper feed mechanism including the feeding roller 10 will be described in detail. The lower tray 50 is provided with an edge guide 52 (FIGS. 6 and 7), which is provided on a bottom surface 50*a* (FIG. 4) thereof and which may slide in the sheet feeding direction. The edge guide 52 guides the position of the trailing edge. Note that the sheet feeding direction (the direction of feeding sheets from the lower tray 50 or the upper tray 60) herein refers to the leftward direction in FIGS. 6 and 7 and a sheet lengthwise direction and a direction of sliding the upper tray 60 refer to the lateral direction in FIGS. 6 and 7. Furthermore, a sheet width direction refers to the direction perpendicular to the sheet surface of FIGS. 6 and 7.

The lower tray 50 is provided with edge guides 51A and 51B (FIG. 4), which may slide in the sheet width direction. The edge guides 51A and 51B regulate the position of side edges of the sheet. In the exemplary embodiment, the two edge guides 51A and 51B for regulating the side edges of the sheet may be displaced in synchronization with each other so that they are symmetrically positioned with respect to the center position in the sheet width direction. In other words, in the printer 1 according to the exemplary embodiment, the center position in the sheet width direction is set as a feed reference position (the same applies for the upper tray 60).

A high friction material 53 is arranged on the bottom surface 50*a* of the lower tray 50 at a location near a location corresponding to the contact position between the feeding roller 10 and the sheet P1. The high friction material 53 is configured to retain a sheet bundle so that the sheet bundle is prevented from being transported to the downstream side at the time of feeding the sheet by the feeding roller 10.

The lower tray 50 is provided with a stopper 50*d*, which is provided on the side of the sheet leading edge (the left side in FIG. 4) and configured to regulate the position of the sheet leading edge. The stopper 50*d* is configured to prevent the sheet to be set to the lower tray 50 from going out of the lower tray 50 when the sheet is set. Note that when the lower tray 50 is mounted to the apparatus body 2, the stopper 50*d* enters backwards in the apparatus to the back of the separation slope 16 and thus the stopper 50*d* does not contact the leading edge of the sheet to be fed. In other words, the stopper 50*d* does not inhibit the feeding of the sheet at the time of feeding the sheet.

As illustrated in FIG. 5, similarly to the lower tray 50, the upper tray 60 is provided with an edge guide 62, which may slide in the sheet lengthwise direction, edge guides 61A and 61B, which may slide in the sheet width direction, and a stopper 60*c*, which are provided on a bottom surface 60*a* of the upper tray 60. In addition, a high friction material 63 is provided near a location corresponding to the contact position between the feeding roller 10 and the sheet P2.

The upper tray 60 is configured to be slidable in the sheet feed direction as described above in the state in which the upper tray 60 is mounted to the apparatus body 2. On an upper surface of one edge of the upper tray 60, a rack portion 60*b* is formed along the direction of sliding the upper tray 60. A rack and pinion mechanism is structured by the engagement of a pinion gear (not illustrated) to the rack portion 60*b*. The upper tray 60 is displaced by sliding between the paper feedable position (the abutting position illustrated in FIG. 7) and the retracted position (FIG. 6) by the rotation of the pinion gear caused by the power of a motor (not illustrated).

Figure 13:
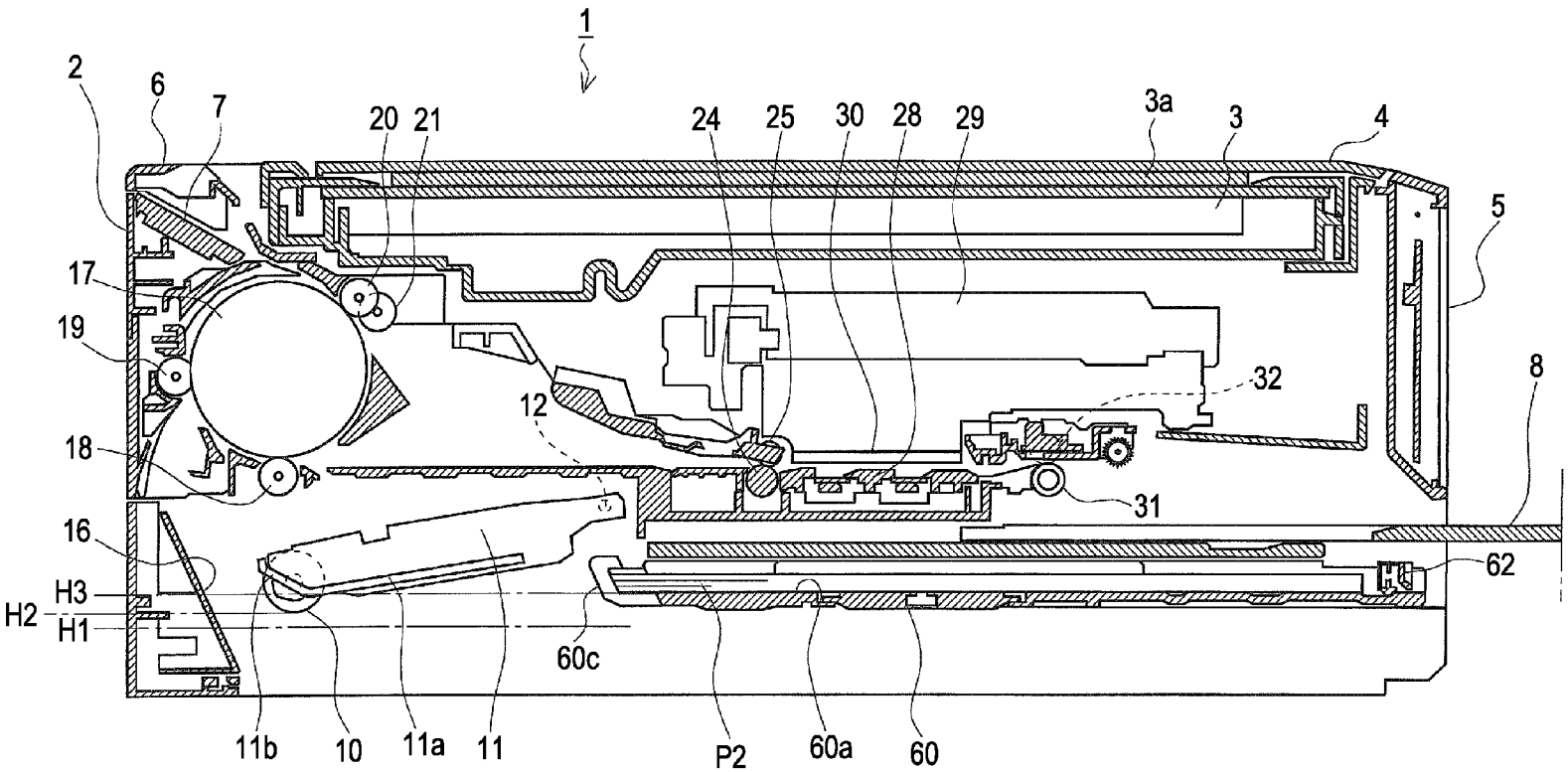
FIG. 13 is a sectional side view illustrating the sheet transport path of the printer according to the invention.
Figure 14:
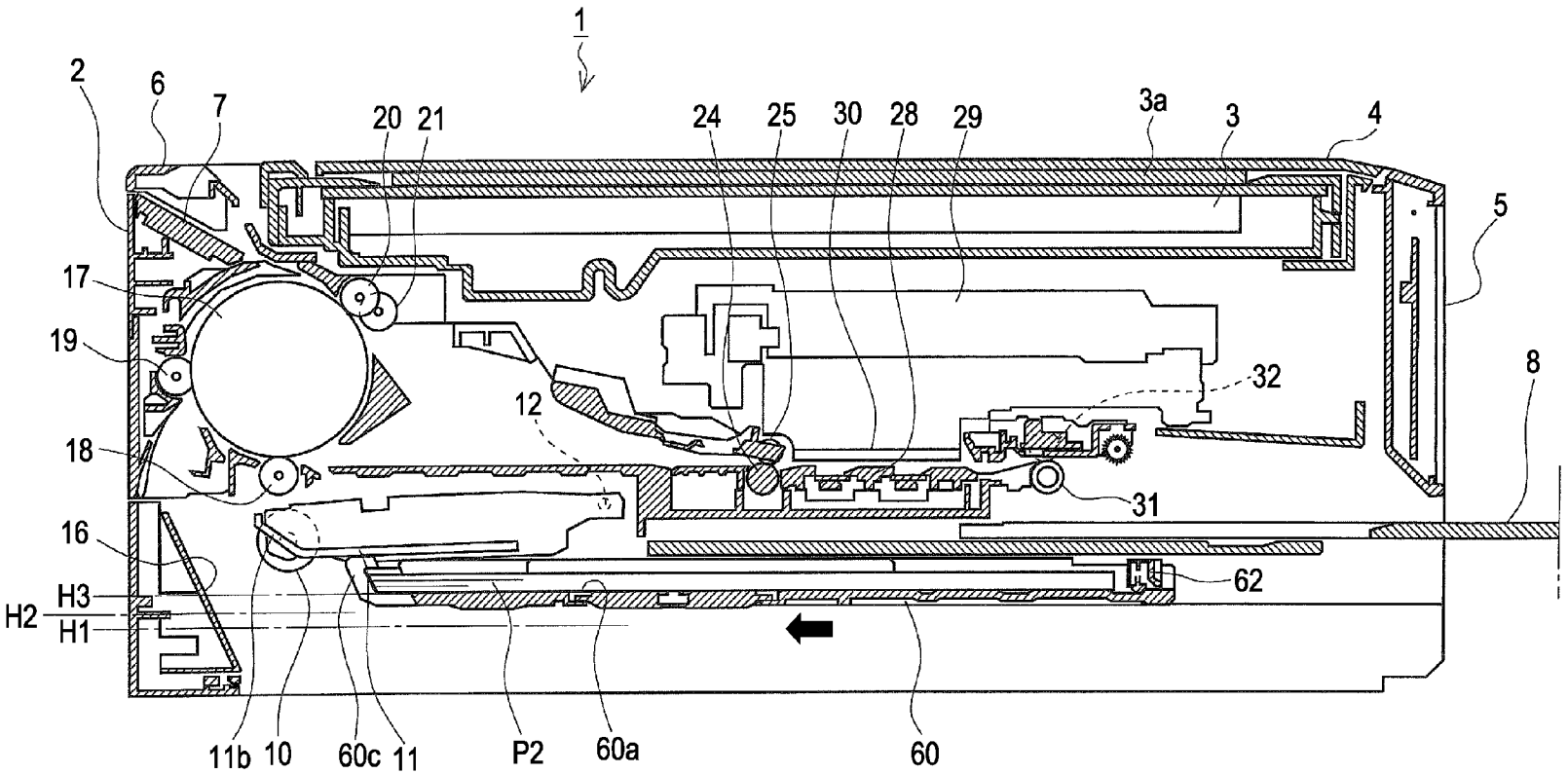
FIG. 14 is a sectional side view illustrating the sheet transport path of the printer according to the invention.
Figure 15:
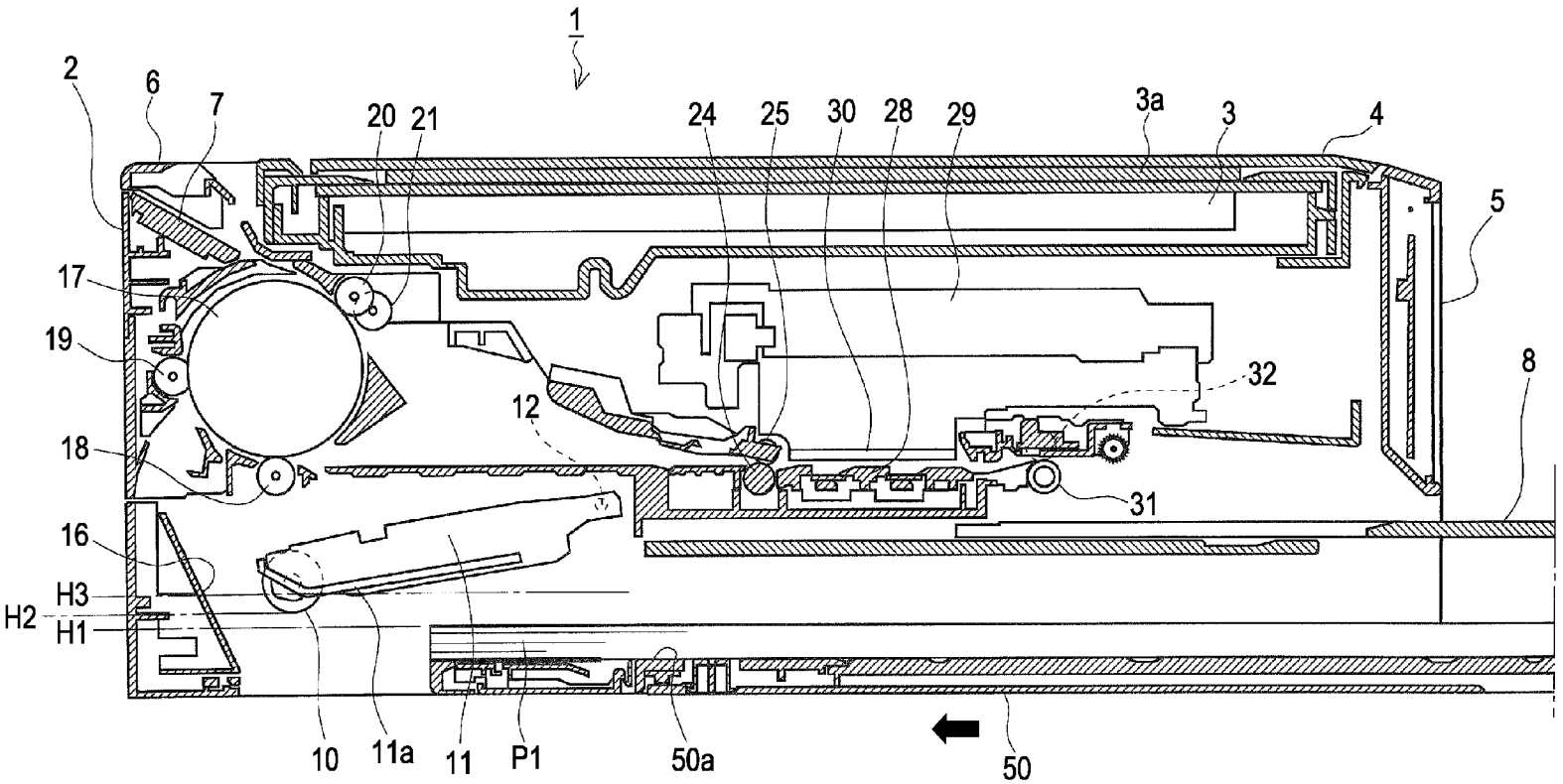
FIG. 15 is a sectional side view illustrating the sheet transport path of the printer according to the invention.
Figure 16:
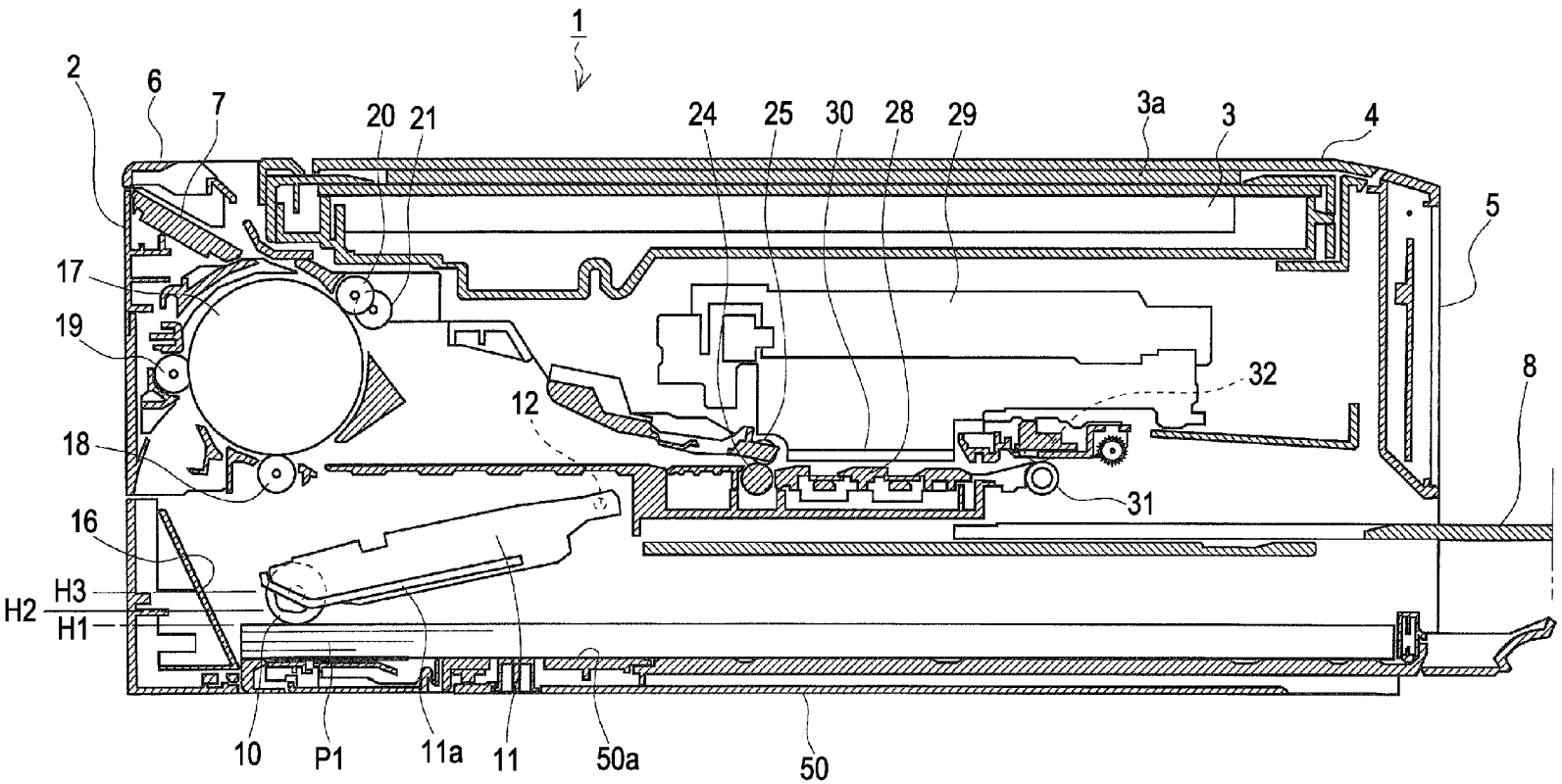
FIG. 16 is a sectional side view illustrating the sheet transport path of the printer according to the invention.

The supporting portion 39 configured to support the feeding roller 10 at an intermediate position will be described below. FIG. 13 illustrates a state in which the upper tray 60 is mounted in a state in which both the lower tray 50 and the upper tray 60 have been dismounted from the apparatus body 2 (hereinafter simply referred to as a "upper and lower trays-unmounted state"). In the upper and lower trays-unmounted state, the feeding roller 10 is supported at the intermediate position (at a position H2 in FIG. 13), which is lower than the position (a position H3 in FIG. 13) of the feeding roller 10 when the feeding roller 10 contacts the bottom surface 60*a* of the upper tray 60 and higher than the position of the feeding roller 10 when the feeding roller 10 contacts the sheet P1 in a state in which the maximum number of sheets P1 are stored in the lower tray 50 (a position H1 in FIG. 13). As described above, the supporting portion 39 is configured to support the feeding roller 10 at the intermediate position H2 in the upper and lower trays-unmounted state.

When the upper tray 60 is inserted into the apparatus body 2 in this state (in a direction indicated by a black solid arrow in FIGS. 13 and 14), in the course of moving of the upper tray 60 to the abutting position (FIG. 7) in the mounting direction, the stopper 60*c* formed on the upper tray 60 engages a cam follower 11*a* formed on the rock member 11. Thus the rock member 11 is pushed upwards and the state thereof is changed from the state illustrated in FIG. 13 to the state illustrated in FIG. 14. Accordingly, the feeding roller 10 is displaced upward from the Intermediate position H2. After that, when the engagement between the stopper 60*c* and the cam follower 11*a* is released, the feeding roller 10 descends to a position at which the feeding roller 10 contacts the sheet P2 stored in the upper tray 60 (FIG. 7). Note that a guiding slope 11*b* is formed on the leading edge of the cam follower 11*a*. When the upper tray 60 is drawn out in the state illustrated in FIG. 7, the stopper 60*c* abuts onto the guiding slope 11*b*. Thus, the rock member 11 is pushed upward again.

When the lower tray 50 is inserted into the apparatus body 2 in the upper and lower trays-unmounted state (in a direction indicated by a black solid arrow in FIG. 15), in the course of moving of the lower tray 50 to the abutting position (FIGS. 6 and 16) in the mounting direction, a pressing portion 50*e* (FIGS. 4 and 9), which is formed on the leading edge of the lower tray 50, engages the supporting portion 39. Thus the support of the feeding roller 10 by the supporting portion 39 at the intermediate position H2 is released. Accordingly, the feeding roller 10 descends from the intermediate position H2 to the position of contact with the sheet P1 stored in the lower tray 50 and the state thereof is changed from the state illustrated in FIG. 15 to the state illustrated in FIG. 16.

The behavior of the feeding roller 10 when each tray is mounted is as described above. The configuration of the supporting portion 39 will be described in detail below. As illustrated in FIGS. 8 through 10, the supporting portion 39 is provided with a slider 43 and a lever member. The slider 43 may slide in the mounting direction of the lower tray 50 and in a direction reverse to the mounting direction of the lower tray 50 and may engage the lower tray 50. The lever member is configured to displace the position of the feeding roller 10 to the intermediate position by contacting the rock member 11. The lever member includes a pivot shaft 40, which is pivotable, a first lever 41, which is provided at one end of the pivot shaft 40 and configured to engage the rock member 11, and a second lever 42, which is provide at the other end of the pivot shaft 40 and capable of engaging the slider 43. In addition, the supporting portion 39 includes a coil spring 44 (illustrated in FIGS. 8 and 10 but not illustrated in FIG. 9), which is an axial pressing portion for pressing the pivot shaft 40 in the direction of pressing the rock member 11 upwards by the first lever 41.

Referring to FIG. 10, a frame 34 (not illustrated in FIGS. 8 and 9) is provided with the slider 43, the pivot shaft 40, and the rock member 11. The coil spring 44 exerts a pressing force between the frame 34 and the second lever 42 and presses the rock member 11 in the direction of pushing the rock member 11 (a lever engagement portion 11*c* of the rock member 11) upward via the second lever 42, the pivot shaft 40, and the first lever 41. Accordingly, when the slider 43 is in a state in which the slider 43 does not engage the lower tray 50 (the pressing portion 50*e*), i.e., in the unmounted state of the lower tray 50, the feeding roller 10 is supported at the intermediate position H2.

In addition, in this state, the second lever 42 presses a second engagement portion 43*b* of the slider 43 in a direction of drawing out the tray. Accordingly, the slider 43 is positioned in the tray draw-out direction in its sliding range. When the lower tray 50 is mounted, the first engagement portion 43*a* of the slider 43 and the pressing portion 50*e* provided on the leading edge of the lower tray 50 engage each other. In this state, the slider 43 is pressed in the direction of mounting the lower tray 50. In this state, the second engagement portion 43*b* of the slider 43 causes the pivot shaft 40 to pivot via the second lever 42 against the pressing force from the coil spring 44. Furthermore, the tip of the first lever 41 descends and the rock member 11 is allowed to rock. Then the support of the pivot shaft 40 at the intermediate position H2 is released, the feeding roller 10 descends, and thus the feeding roller 10 may contact the sheet P1 stored in the lower tray 50.

An action and an effect of the supporting portion 39 will be described below. Suppose that a configuration is employed in which the feeding roller 10 is retracted upward in the upper and lower trays-unmounted state so that the feeding roller 10 does not abut onto both the upper and the lower trays. In this case, a supporting portion for supporting the feeding roller 10 at the retracted position in the upper and lower trays-unmounted state becomes necessary. Furthermore, in this case, it is necessary to provide each of the lower tray 50 and the upper tray 60 with a configuration for releasing the state of supporting the feeding roller 10 at the upper position by the corresponding supporting portion. Therefore, as a result, the apparatus configuration may become complicated and the costs for the apparatus may increase.

However, according to the exemplary embodiment, as described above, the feeding roller 10 is supported at the intermediate position H2 in the upper and lower trays-unmounted state, the upper tray 60 itself pushes aside the rock member 11 when the upper tray 60 is mounted, and the feeding roller 10 is configured to descend to the position of contact with the sheet P2 stored in the upper tray 60. In other words, in the exemplary embodiment, the configuration for releasing the state of supporting the feeding roller 10 at the intermediate position H2 may be provided only for the lower tray 50 and is not necessary for the upper tray 60. Accordingly, the size of the apparatus may be decreased and the costs for the apparatus may be decreased in the recording apparatus including two or more trays.

Note that the stopper 60*c* of the upper tray 60 pushes upward the rock member 11 when the upper tray 60 is moved to the abutting position in its mounting direction in the mounted state of the lower tray 50 (i.e., in the state in which the feeding roller 10 contacts the sheet P1 stored in the lower tray 50). In addition, if the lower tray 50 is mounted in the state in which the upper tray 60 is positioned at the abutting position in its mounting direction, the lower tray 50 causes the slider 43 to slide in the mounting direction but the rock member 11 has been pushed by the upper tray 60 upward. That is, because the lever engagement portion 11*c* of the rock member 11 is positioned at a position upward from the first lever 41, the first lever 41 descends but the rock member 11 does not rock.

With respect to the angle formed by the stored sheet and the rock member 11 (i.e., an angle $\alpha$ in FIG. 6 (a wedge angle)), the angle $\alpha$ formed by the stored sheet P2 in the upper tray 60 and the rock member 11 is smaller than the angle $\alpha$ formed by the stored sheet P1 in the lower tray 50 and the rock member 11. In addition, if a large number of sheets are stored, the wedge angle becomes small compared to a case where a small number of sheets are stored. If the wedge angle becomes small, the force of contact between the feeding roller 10 and the sheet P becomes small. As a result, the phenomenon of nonfeed tends to occur. Note that the wedge angle $\alpha$ is, in a strict sense, an angle formed by a line extending from the position at which the feeding roller 10 and the sheet P contact each other to the axial center position of the pivot shaft 12 and the recording surface of the sheet P.

In the exemplary embodiment, a coil spring 37 (FIGS. 11 and 12) is provided, which is a roller pressing portion for pressing the feeding roller 10 toward the sheet P2 stored in the upper tray 60 when a predetermined number of sheets or more sheets P2 are stored in the upper tray 60. Two coil springs 37 are provided to correspond to the two feeding rollers 10, which are provided on both sides of the transmission receiving gear 15.

More specifically, the rock member 11 is provided with the coil spring 37 and the coil spring 37 may engage a spring pressing portion 34*a*, which is formed so as to protrude from the frame 34 downwards. When a predetermined number of sheets or more sheets P2 are stored in the upper tray 60, the coil spring 37 engages the spring pressing portion 34*a*. The coil spring 37 is configured so that the length of spring of the coil spring 37 becomes shorter as the wedge angle becomes smaller. Accordingly, the nonfeed may be prevented because the contact force between the feeding roller 10 and the sheet P2 is compensated for when the wedge angle becomes small as described above.

Note that the range of pivot of the first lever 41 illustrated in FIG. 8 is regulated by a stopper (not illustrated) so that the first lever 41 does not pivot further upward compared to the state of the first lever 41 achieved when the feeding roller 10 is supported at the intermediate position H2 (i.e., so as not to press the lever engagement portion 11*c* upward). In other words, the pressing force from the coil spring 44 does not affect the force of contact between the feeding roller 10 and the sheet P2 applied when the sheet P2 is fed from the upper tray 60. Furthermore, because the first lever 41 releases the locking of the posture of the rock member 11 when the sheet P1 is fed from the lower tray 50, the force of contact between the feeding roller 10 and the sheet P1 is not affected, similarly to the above-described case.

Note that the above-described exemplary embodiment employs a configuration including two trays of the lower tray 50 and the upper tray 60. However, the invention is not limited to this. That is, more than two trays may of course be respectively and detachably provided.

The entire disclosure of Japanese Patent Application No. 2012-043996, filed Feb. 29, 2012, is expressly incorporated by reference herein.

What is claimed is:

1. A recording apparatus comprising:

a recording unit configured to execute recording on a recording medium;

a lower tray which is detachably mounted to an apparatus body including the recording unit and which is configured to store a recording medium;

an upper tray provided above the lower tray, which is detachably mounted to the apparatus body and which is configured to store a recording medium; and a feeding roller capable of contacting each of the recording medium stored in the lower tray and the recording medium stored in the upper tray from above, wherein the feeding roller is supported at an intermediate position, which is lower than a position of the feeding roller reached when the feeding roller contacts a bottom surface of the upper tray and higher than a position of the feeding roller reached when the feeding roller contacts a recording medium set as a top sheet in a state in which a maximum number of recording media are stored in the lower tray, in a state of the upper tray and the lower tray being detached from the apparatus body, wherein, in a course of moving the lower tray to an abutting position in the mounting direction, the lower tray is configured to release the support of the feeding roller at the intermediate position and descend the feeding roller to a position at which the feeding roller contacts the recording medium stored in the lower tray.

2. The recording apparatus according to claim 1, wherein in a course of moving the upper tray to an abutting position in a mounting direction, the feeding roller is displaced upward from the intermediate position when the upper tray is moved, and subsequently the feeding roller is allowed to descend to a position at which the feeding roller contacts the recording medium stored in the upper tray.

3. The recording apparatus according to claim 2, further comprising:

a rock member provided with the feeding roller; and a pressing member configured to press the rock member in a direction in which an angle formed by a line extending from a position at which the feeding roller and the recording medium contact each other to the center position of a rocking shaft of the rock member and a surface of the recording medium increases, when the angle becomes smaller than a predetermined angle.

4. The recording apparatus according to claim 2, wherein the upper tray includes a stopper portion, which is provided in a leading edge portion thereof in a recording medium feeding direction and capable of contacting a leading edge of the recording medium, and wherein the stopper portion is configured to push aside the rock member to displace the position of the feeding roller in a course of moving the upper tray to the abutting position in the mounting direction.

5. The recording apparatus according to claim 1, further comprising:

a rock member provided with the feeding roller; and a support member configured to support the rock member and support the feeding roller at a position equivalent to the intermediate position, wherein the support member is configured to engage the lower tray, release the support executed thereby, and release the support of the feeding roller at the intermediate position.

6. The recording apparatus according to claim 5, wherein the support member includes:

a lever member configured to displace the position of the feeding roller to the intermediate position by contacting the rock member;

a pressing member configured to support the position of the feeding roller at the intermediate position by pressing the lever member; and a slider configured to engage the lever member and contact the lower tray in the course of moving the lower tray to the abutting position in the mounting direction, wherein the slider is configured to contact the lower tray, slide against a pressing force from the pressing member, and release the support of the feeding roller by the lever member at the intermediate position, in the course of moving the lower tray to the abutting position in the mounting direction.

7. The recording apparatus according to claim 1, wherein the upper tray is shorter than the lower tray in the direction of feeding the medium.

* * * * *